United States Patent [19]

Charnley

[11] 4,301,600

[45] Nov. 24, 1981

[54] LOCATING MECHANISM

[75] Inventor: Peter W. Charnley, South River, N.J.

[73] Assignee: General Hardware Manufacturing Company, New York, N.Y.

[21] Appl. No.: 123,587

[22] Filed: Feb. 22, 1980

[51] Int. Cl.[3] ..... B43L 7/06

[52] U.S. Cl. ..... 33/464

[58] Field of Search ..... 151/4.5, 68, 24, 28; 33/464, 427, 428, 173

[56] References Cited

U.S. PATENT DOCUMENTS

| | | | |
|---|---|---|---|
| 968,679 | 8/1910 | Oenrle | 33/427 X |
| 1,036,491 | 8/1912 | Henderson | 33/427 X |
| 1,127,802 | 2/1915 | Palmer | 33/473 |
| 2,085,461 | 6/1937 | Chafee | 33/428 |
| 2,194,085 | 3/1940 | Hastings | 33/464 |
| 2,448,440 | 8/1948 | King | 33/427 |

*Primary Examiner*—Harry N. Haroian

*Attorney, Agent, or Firm*—Ladas & Parry

[57] ABSTRACT

A locating mechanism in which a pin or bolt is slidably accommodated in a bore for movement between a locking position and an unlocking position. The pin has a locking projection at one end and is provided with means for preventing rotation of the pin within the bore and hence ensuring that the locking projection is at all times oriented in the desired direction. The means is also operable to limit the extent by which the pin or bolt may slide longitudinally within the bore and, hence, serves to control the degree of travel of the locking projection. The means is a C-spring which extends radially outwardly from the pin or bolt and is seated in a registering recess which opens into the bore. In this manner the C-spring will prevent rotation of the pin within the bore and will permit longitudinal displacement of the pin in the bore by an extent corresponding to the permissible flexing of the C-spring until such time as the limbs of the C-spring come together into abutting relationship.

12 Claims, 4 Drawing Figures

FIG. 1
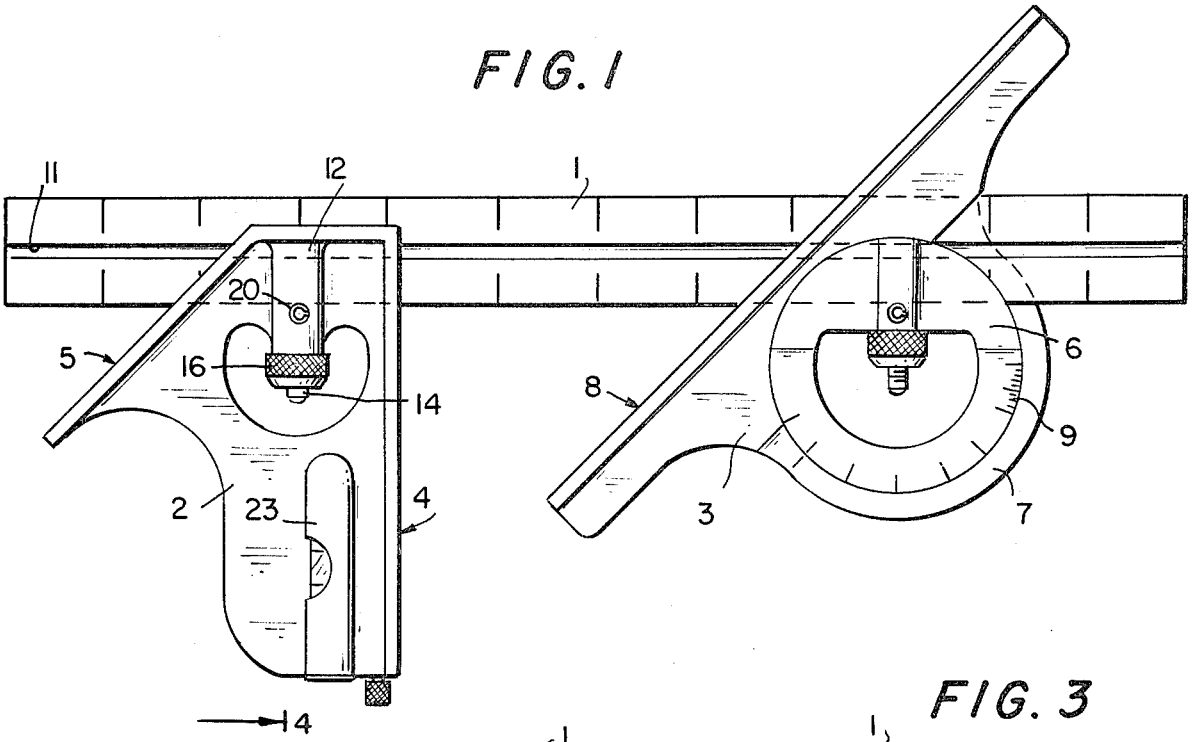
FIG. 3
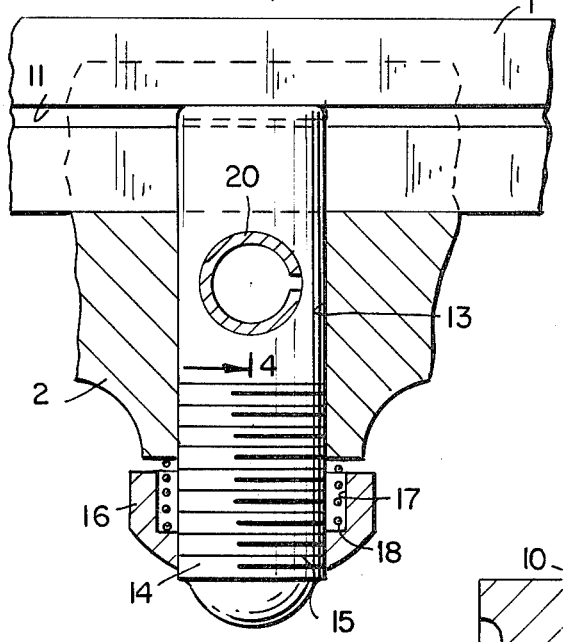
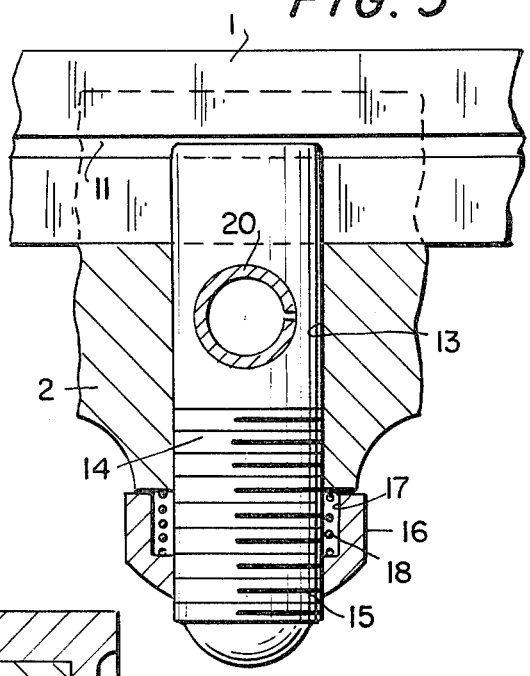
FIG. 2
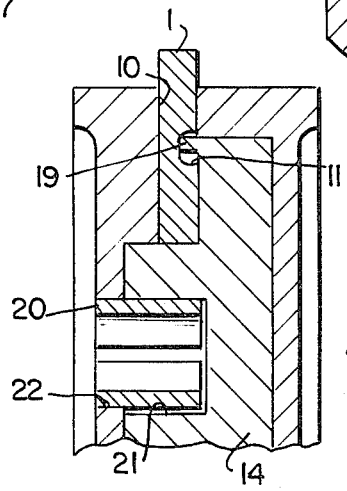
FIG. 4

LOCATING MECHANISM

BACKGROUND OF THE INVENTION

This invention is concerned with a locating mechanism and finds particular, but not exclusive, application in combinations involving a slide displaceable along a track. Such combinations are common in draughtsman's tools where a square is displaceable along a rule and is required to be clamped at a desired location on that rule.

Such a square involves a casting having a slot dimensioned to receive the rule and a pin extending into the slot and having a projection dimensioned to engage in a groove extending along the length of the rule. By retracting the pin, transversely away from the groove, the projection will move into an interference fit with the groove wall and serve securely to lock the casting in position. U.S. Pat. No. 1,532,353 discloses a combination tool in which a miter box is securable on a rule by such a locking mechanism.

Such locking mechanisms suffer from the disadvantage that when the casting or slide is removed from the rule some degree of dexterity is required to manipulate the projection into alignment with the groove to permit reintroduction of the slide or casting onto the rule.

SUMMARY OF THE INVENTION

The invention obviates this disadvantage of the prior art by providing a reliable locating mechanism which serves to ensure that the locking projection is appropriately located for introduction onto the rule.

As will be explained hereinafter, the invention is in no way limited to combinations involving a slide and a grooved rule and broadly emcompasses locating mechanisms which serve positively to orientate a locking pin or bolt in a desired position.

A further object of the invention is not only to orientate such a pin or bolt in the desired angular position but also to limit longitudinal displacement of the pin or bolt within an accomodating bore.

In its broadest concept, the present invention provides a locating mechanism comprising a body having a bore extending therethrough, an elongated pin seated and longitudinally displaceable within said bore, and a spring member having a first end seated within a transverse bore in said pin and a second end accomodated in a registering bore in said body. The spring member is a C-spring.

In the intended environment of draughtsman's tools, a preferred embodiment of the invention provides a drawing angle or protractor for mounting on a rule, said angle or protractor comprising a body having an angle reference surface and a slot opening into said reference surface, a bore within the body and opening into said slot, an elongated pin longitudinally displaceable within said bore and having one end provided with a locking projection disposed in said slot and the opposite end in screwthreaded engagement with a nut operable to draw the pin longitudinally through said bore, and a C-spring having one end seated in a radial bore in the pin and the other end seated in a registering recess in the body to prevent rotation of the pin within the bore while permitting limited longitudinal displacement of said pin in said bore.

BRIEF DESCRIPTION OF THE DRAWINGS

FIG. 1 shows a side elevation of a combination tool having two components incorporating the present invention;

FIG. 2 is an enlarged sectioned elevation through a detail of FIG. 1 showing an unlocked position;

FIG. 3 is a sectioned elevation similar to FIG. 2 but showing a locked position;

FIG. 4 is a section taken along the line 4—4 of FIG. 2.

DESCRIPTION OF THE PREFERRED EMBODIMENTS

FIG. 1 shows a side elevation of a combination tool comprising a rule 1 having two components slidably mounted thereon. The left hand component 2 is a combined draughtman's angle and square and the right hand component is a draughtman's protractor 3. The angle and square comprises two reference faces 4 and 5, the first of which defines a right angle with the lower edge of the rule and the second of which defines a fixed acute angle with respect to the same lower edge.

The protractor 3 includes an inner member 6 which is slidable along the rule but is otherwised fixed with respect thereto and an outer member 7 supportable by said inner member and rotatable therearound. The outer member 7 incorporates a reference face 8 which will make either a lesser included angle or a greater included angle with the lower edge of the rule depending upon the relative position of the outer member with respect to the inner member. A reference mark (not shown) engraved or otherwise provided on the outer member can be aligned with a circular scale 9 on the inner member either to preset or to indicate the included angle. The circular scale 9 can extend through any appropriate arc but preferably subtends a total angle of 180°. The outer member is clamped in the desired position on and with respect to the inner member by conventional screw means, not shown.

Both the angle and square component 2 and the protractor component 3 are slotted to receive the rule 1. As most clearly shown in FIG. 4 of the drawing, the slot 10 in the angle and square component extends through one end thereof and opens into both the references faces 4 and 5. A similar slot extends through one end of the inner member 6 of the protractor whereas a very much larger slot necessarily extends through the outer member 7 to permit rotation of that outer member round the inner member.

The rule 1 comprises a groove 11 extending along its length to receive a locating mechanism carried by the components which are selectively slidable along the length of the rule.

That locating mechanism will now be described in detail. Since the locating mechanism is the same in both components, it will be described specifically with reference to the angle and square component shown in greater detail in FIGS. 2 to 4 of the drawing.

As most clearly shown in FIG. 1, the body of the angle and square is a metal casting and that casting includes a barrel 12 defining an internal bore 13 which opens into the slot 10. A pin or bolt 14 is a accomodated in the bore 13 and is longitudinally displaceable to a limited extend within said bore. The longitudinal displacement is most conveniently effected by providing a screwthreaded portion 15 on the bolt at and towards the end remote from the slot 10. A nut 16 is threadedly engaged on the screwthreaded portion 15 and abuts the end extremity of the barrel 12. To assist in manipulation of the locating and locking mechanism, the external peripheral surface of the nut is preferably knurled to facilitate grasping and the underside of the nut is dished at 17 to receive a spacing coil spring 18.

From the foregoing it will be appreciated that rotation of the nut on the threads will serve initially to draw the nut down into abutting engagement with the end of the barrel against the influence of the spring 18 and will thereafter cause the pin 14 to be withdrawn in the bore 13 in the direction away from the grooved rule 1.

The end of the pin remote from the screwthreaded end is provided with a projecting tongue 19 having a depth which is less than the width of the groove 11. The projection 19 seats within the groove and, in the unlocked position, permits the angle and square freely to slide along the length of the rule 1. FIGS. 2 and 4 show the unlocked position where there is clearance between the underside of the projection 19 and the sidewall of the groove 11.

Upon rotation of the nut 16 and the consequential withdrawal of the pin 14 away from the rule 1, the underside of the projection 19 will move, downwardly as shown in FIG. 4, to abut the sidewall of the groove 11. At this point only minimal further withdrawal of the pin is required to provide a jamming interference which will serve to clamp the angle and square in the locked condition.

Although the foregoing components would operate with a degree of satisfaction with only the structural features described, there would be an inherent problem in that, in the absence of a rule seated in the slot 10, the pin 14 would be free to rotate within the bore 13 and the projection 19 would no longer be oriented to be received within the groove 11 when the rule is slid into the slot 10. Moreover, not only would the projection 19 be angularly rotated out of the desired position but also, with the structural features as described, the pin would be free to move longitudinally in the bore and would no longer occupy the intended location for insertion into the groove 11.

To solve this problem the present invention utilizes an element which serves both to prevent rotation of the pin within the bore and to limit longitudinal displacement of said pin.

This element is in the form of a C-spring 20. As most clearly shown in FIG. 4 of the drawing, this C-spring 20 has one end seated in a blind bore 21 provided radially in the pin 14 and the opposite end seated in a registering bore 22 in the barrel wall. Although this is the preferred arrangement, it will, of course, be appreciated that a diametrically extending hole could be drilled completely through the barrel and accomodated pin and the C-shaped spring could extend therethrough and be retained at both ends by the barrel wall.

The C-spring 20 thus serves positively to prevent rotation of the pin 14 within the bore 13. In addition in its expanded or unstressed condition, the limbs of the C are spaced apart and urge the projection 19 into the position shown in FIG. 4. With the projection 19 reliably although resiliently held in this position, it becomes an easy matter to slide the draughtsman's component onto the rule.

Upon exerting a tightening action on the nut 16, the pin 14 will be withdrawn, as aforesaid, against the spring action of the C-spring. Thereupon the spring will yield until such time as the projection 19 moves into locking contact with the sidewall of the groove 11. As most clearly shown in FIG. 3 of the drawing, at this time there will still be a gap between the limbs of the C, although such gap will necessarily be very much smaller.

When the angle and square is removed from the rule, the C-spring serves to prevent the pin 14 from falling out of the bore 13. In the event that unintentional withdrawing force is exerted (in the absence of a rule) by turning of the nut 16, the pin 14 could only be withdrawn until such time as the limbs of the C-shaped spring come into abutting contact. Thereafter, further withdrawal of the pin 14 would be impossible.

In order to prevent the C-spring from falling out and becoming lost, the registering bore 22 in the barrel wall is preferably dimensioned to provide an interference fit with the C-shaped spring when said spring is in its unstressed condition.

Both the angle and square and the protractor described and illustrated in the drawing may be equipped with conventional aides which increase their utility but which are not concerned with the locating and locking mechanism of the invention. Thus, for example, the conventional bubble spirit level 23may be incorporated in the casting.

Whilst the locating mechanism of the invention has been specifically described with reference to draughtsman's tools, it will be appreciated that the novel locating and locking mechanism can be utilized for a variety of purposes where it is desired positively to locate a bolt or light-locking projection. Such bolt or locking projection need not necessarily be designed to engage in a groove and, in fact, may be arranged to engage any appropriate cooperating abutment surface.

I claim:

1. A locating mechanism comprising a body having a bore extending therethrough, an elongated pin seated and longitudinally displaceable within said bore, and a C-spring having a first end seated within a transverse bore in said pin and a second end accommodated in a registering bore in said body.

2. A locating mechanism as claimed in claim 1, wherein the transverse bore in the pin is a blind bore and wherein said first end of the C-spring is loosely seated in said blind bore.

3. A locating mechanism as claimed in claim 2, wherein the second end of the C-spring is retained in said registering bore in the body by an interference fit.

4. A locating mechanism as claimed in claim 1, wherein a locking abutment surface is provided at one end of the elongated pin and wherein the opposite end is provided with means for drawing the pin longitudinally through the bore against the bias of the spring member to clamp said locking abutment surface in engagement with a cooperating surface.

5. A locating mechanism as claimed in claim 4, wherein the end of the elongated pin remote from the locking abutment surface is screwthreaded and wherein the means for drawing the pin through the bore is a cooperating nut rotatably mounted on said screwthreaded end.

6. A locating mechanism as claimed in claim 4 or claim 5, wherein the body is slotted slidably to straddle a track, wherein the locking abutment surface seats in a groove formed longitudinally along said track to retain said body astride said track, said body being clampable in a desired location on said track by displacement of the pin within the bore.

7. A locating mechanism as claimed in claim 6, wherein the body is a draughtsman's square and the grooved track is a rule.

8. A locating mechanism as claimed in claim 6, wherein the body is a draughtsman's protractor and the grooved track is a rule.

9. A locating mechanism comprising a body slidably mounted on a track, an elongated pin seated within a bore in said body and having a locking projection engagable with said track, a C-spring having one end seated in a transverse bore in the pin and the opposite end seated in a registering bore in the body and means for displacing said pin through said bore against the bias of said spring to move the projection into locking engagement with the track.

10. A drawing angle for mounting on a rule, said angle comprising a body having an angle reference surface and a slot opening into said reference surface, a bore within the body and opening into said slot, an elongated pin longitudinally displaceable within said bore and having one end provided with a locking projection disposed in said slot and the opposite end in screwthreaded engagement with a nut operable to draw the pin longitudinally through said bore, and a C-spring having one end seated in a radial bore in the pin and the other end seated in a registering recess in the body to prevent rotation of the pin within the bore while permitting limited longitudinal displacement of said pin in said bore.

11. A drawing angle as claimed in claim 10 in combination with a rule having a groove extending longitudinally therealong and dimensioned slidably to receive the locking projection on the pin.

12. In drawing protractor and rule combination comprising an inner member keyed on a reference base and bearing an angular scale and an outer member rotatable around the inner member and incorporating a reference surface antularly displaceable with respect to said reference base to form therewith a selectively adjustable included angle, the improvement wherein the keyed mounting between the inner member and the reference base incorporates a groove extending at least part way along said base, a pin slidably accommodated in a bore formed in the inner member, said pin having a locking projection at one end seatable within said groove and means proximate the other end for drawing said pin through said bore away from said groove to draw said projection into locking engagement with the groove sidewall, and a C-spring having a first end seated within a transverse bore in the pin and a second end seated in a registering recess opening into the pin accommodating bore to prevent rotation of said pin within said bore and to limit sliding movement of said pin.

* * * * *